US008490841B2

(12) United States Patent
Yamamoto et al.

(10) Patent No.: US 8,490,841 B2
(45) Date of Patent: Jul. 23, 2013

(54) SUBMERGED NOZZLE SUPPORTING-REPLACING MECHANISM

(75) Inventors: Kenji Yamamoto, Tokyo (JP); Mototsugu Osada, Tokyo (JP)

(73) Assignee: Shinagawa Refractories Co., Ltd., Tokyo (JP)

( * ) Notice: Subject to any disclaimer, the term of this patent is extended or adjusted under 35 U.S.C. 154(b) by 669 days.

(21) Appl. No.: 12/677,936

(22) PCT Filed: Jan. 5, 2009

(86) PCT No.: PCT/JP2009/050003

§ 371 (c)(1), (2), (4) Date: Mar. 12, 2010

(87) PCT Pub. No.: WO2009/090891

PCT Pub. Date: Jul. 23, 2009

(65) Prior Publication Data

US 2010/0242245 A1 Sep. 30, 2010

(30) Foreign Application Priority Data

Jan. 16, 2008 (JP) ..... 2008-006797
Mar. 3, 2008 (JP) ..... 2008-051799

(51) Int. Cl.

| | |
|---|---|
| ***B22D 35/00*** | (2006.01) |
| ***B22D 37/00*** | (2006.01) |
| ***B22D 39/00*** | (2006.01) |
| ***B67D 7/00*** | (2010.01) |

(52) U.S. Cl.
USPC ..... 222/606; 222/591; 222/600; 266/236

(58) Field of Classification Search
USPC .. 222/591, 597, 606, 607, 600, 595; 266/236, 266/DIG. 1; 164/437
See application file for complete search history.

(56) References Cited

U.S. PATENT DOCUMENTS 4,669,528 A * 6/1987 Szadkowski ..... 164/437
4,693,401 A 9/1987 Nishimura et al.

(Continued)

FOREIGN PATENT DOCUMENTS

EP 0 835 706 1/2000
EP 0 966 334 7/2001

(Continued)

OTHER PUBLICATIONS

Notification of Reasons for Refusal (with English translation) dated Sep. 7, 2010 in corresponding Japanese Patent Application No. 2008-051799.

(Continued)

*Primary Examiner* — Chi Q Nguyen
(74) *Attorney, Agent, or Firm* — Wenderoth, Lind & Ponack, LLP

(57) ABSTRACT

A submerged nozzle supporting-replacing mechanism, which is constituted to set an entire width dimension (L3) of each of clampers (20 and 21) to be smaller than a flange diameter dimension (L1) of a submerged nozzle (9) so as to position each of the clampers (20 and 21) by a positioning member (26), and so as to guide an upper surface (43) of a fresh submerged nozzle (9A) by a positioning liner (6), to thereby regulate a height position of the fresh submerged nozzle (9A) during movement in a horizontal direction thereof. The position of the clampers are regulated by setting the entire width dimension of the clampers to be smaller than the flange diameter dimension of the submerged nozzle, which can be smoothly replaced by providing the positioning liner.

12 Claims, 8 Drawing Sheets

U.S. PATENT DOCUMENTS

| | | | | |
|---|---|---|---|---|
| 5,044,533 | A * | 9/1991 | King | 222/606 |
| 5,170,915 | A * | 12/1992 | Szadkowski | 222/600 |
| 5,688,425 | A * | 11/1997 | Yamamoto et al. | 222/606 |
| 5,879,579 | A | 3/1999 | Yoshino et al. | |
| 6,073,817 | A * | 6/2000 | Jairazbhoy | 222/595 |
| 6,213,357 | B1 | 4/2001 | Collura | |
| 6,772,922 | B2 * | 8/2004 | Renard et al. | 222/600 |
| 2003/0029892 | A1 | 2/2003 | Kawano et al. | |
| 2006/0137849 | A1 | 6/2006 | Kawano et al. | |

FOREIGN PATENT DOCUMENTS

| | | |
|---|---|---|
| EP | 1 391 257 | 8/2008 |
| JP | 4-50100 | 8/1992 |
| JP | 2001-515410 | 9/2001 |
| JP | 3232294 | 11/2001 |
| JP | 3523965 | 4/2004 |
| JP | 3781371 | 5/2006 |
| WO | 98/41344 | 9/1998 |
| WO | 02/094476 | 11/2002 |

OTHER PUBLICATIONS

International Search Report issued Apr. 24, 2009 in International (PCT) Application No. PCT/JP2009/050003.

* cited by examiner

SUBMERGED NOZZLE SUPPORTING-REPLACING MECHANISM

BACKGROUND OF THE INVENTION

1. Technical Field

The present invention relates to a submerged nozzle supporting-replacing mechanism. In particular, the present invention relates to a novel improvement for regulating a position of each of clampers by a positioning member by setting each of entire width dimensions of the clampers to be smaller than a flange diameter dimension of a submerged nozzle, and for achieving a simple and low-cost structure and a reduction in size and weight of a fire-proof object by regulating a height position of a fresh submerged nozzle by a positioning liner.

2. Description of the Related Art

As a submerged nozzle supporting-replacing mechanism of this type, which has been conventionally used, there are exemplified structures described below, for example.

That is, in a first conventional example described in Japanese Utility Model Registration No. 3009112, a joint plane of an upper fire-proof object, with which a submerged nozzle comes into contact, is set to be larger than a joint plane of the submerged nozzle. A fresh submerged nozzle for replacement is arranged below a joint surface of the upper fire-proof object at an inserting position. When the fresh submerged nozzle is caused to slide for replacement, the fresh submerged nozzle is caused to slide up to a tapping hole while being pressed through oscillating levers against the joint surface of the upper fire-proof object.

Further, a plurality of oscillating levers is arranged within the substantially same width as that of a submerged-nozzle upper-flange.

Further, in a second conventional example described in JP 3781371, a fresh submerged nozzle is provided with a pressing-force biasing mechanism so as not to come into contact with its upper nozzle during movement from the inserting position to a casting position. The biasing mechanism is provided with a slide frame with a purpose of adjusting a height position of a keyboard, which presses the submerged nozzle. The slide frame moves correspondingly to movement of the fresh submerged nozzle so as to adjust the height of each of a plurality of keyboards. Thus, a structure is obtained, in which the submerged nozzle does not come into contact with the upper nozzle.

Further, in this case, joint surfaces of the submerged nozzle and the upper fire-proof object are designed so as to be the substantially same in size.

The mechanism causes the fresh submerged nozzle to move up to the tapping hole so as not to come into contact with the upper fire-proof object, with a purpose of not damaging the joint surface of the fresh submerged nozzle.

Further, in a third conventional example described in JP 3834741, the fresh submerged nozzle is provided with an oscillating arm, which is biased by a pressing means so as not to come into contact with its upper nozzle during movement from the inserting position to the casting position. The oscillating arm controls, with first and second protrusions, a slide position, a height position, and a pressing force of the submerged nozzle retained in a submerged-nozzle retaining case.

Further, in this case, joint surfaces of the submerged nozzle and the upper fire-proof object are designed so as to be the substantially same in size.

SUMMARY OF THE INVENTION

1. Problems to be Solved by the Invention

The conventional submerged nozzle supporting-replacing mechanisms are structured as described above, and hence there are the following problems.

(1) In the first conventional example, it is necessary to enlarge the joint surface of the upper fire-proof object, with which the submerged nozzle comes into contact, and hence the fire-proof object increases in weight, which leads a low workability. Further, the weight thereof is heavy and the joint surface is large. As a result, in order to ensure a plane accuracy during a manufacturing process, the fire-proof object increases in cost.

(2) In the second conventional example and the third conventional example, the pressing force biasing mechanism for controlling movement of the submerged nozzle is complicated, and apparatus cost is high. Further, there is a defect in that maintenance cost also increases.

2. Means for Solving the Problems

A submerged nozzle supporting-replacing mechanism according to the present invention includes: first and second clampers, which are provided on a side of a lower frame of a slide valve device controlling a flow rate of molten metal from a tundish to a mold, and are located on both sides of a submerged nozzle so as to press the submerged nozzle during casting against an upper fire-proof object; a spring provided to a supporting protrusion of the lower frame, for upwardly biasing each of the clampers; two pairs of guide rails provided to a frame on the side of the lower frame, for guiding movement in a horizontal direction of the submerged nozzle; and an extruding device for pushing the submerged nozzle in the horizontal direction, in which: an entire width dimension of each of the first and second clampers is set to be smaller than a flange diameter dimension of a flange of the submerged nozzle; a positioning member, which is provided so as to be suspended from the supporting protrusion, is engaged to the first and second clampers so as to position each of the clampers; and a positioning liner, which is provided on a lower surface of the lower frame, guides an upper surface of a subsequent and fresh submerged nozzle replacing the submerged nozzle, to thereby regulate a height position of the fresh submerged nozzle during movement in the horizontal direction of the fresh submerged nozzle. Further, each of clamper pieces of the first and second clampers is axially supported through a pin, the positioning member passes through a through-hole formed in a rear portion of each of the clamper pieces, and an enlarged portion, which is formed at a tip of the positioning member, is engaged to the rear portion. Further, a clamper center, which indicates a width center of the entire width dimension of each of the first and second clampers, is corresponding to a flange center, which indicates a width center of the flange diameter dimension. Between the flange diameter dimension and a first arranging width measured from the clamper center up to an upstream end on an upstream side, a relation of $L1:L2=1:0.2$ to 0.4 is set. Further, a tip end upper portion of each of the clamper pieces of the first and second clampers is shaped into a curved-surface-shape including a predetermined arc. Further, of the respective clamper pieces of the first and second clampers, a tip end upper portion of only each of the clamper pieces located on a most deeply inserting side or tip end upper portions of all the clamper pieces are shaped into an inclined-surface-shape. Further, a submerged nozzle supporting-replacing mechanism includes: first and second clampers, which are provided on a downstream side of a stopper device controlling a flow rate of molten metal from a tundish to a mold, and are located on both sides of a submerged nozzle so as to press the submerged nozzle during casting against an upper fire-proof object; a spring provided to a supporting protrusion of the lower frame, for upwardly biasing each of the clampers; two pairs of guide rails provided to a frame on a side of the lower frame, for guiding movement in a horizontal direction of the submerged nozzle; and an extruding device for pushing the submerged nozzle in the horizontal direction, in which: an entire width dimension of each of the first and second clampers is set to be smaller than a flange diameter dimension of a flange of the submerged nozzle; a positioning member, which is provided so as to be suspended from the supporting protrusion, is engaged to the first and second clampers so as to position each of the clampers; and a positioning liner, which is provided on a lower surface of the lower frame, guides an upper surface of a subsequent and fresh submerged nozzle replacing the submerged nozzle, to thereby regulate a height position of the fresh submerged nozzle during movement in the horizontal direction of the fresh submerged nozzle. Further, each of clamper pieces of the first and second clampers is axially supported through a pin, the positioning member passes through a through-hole formed in a rear portion of each of the clamper pieces, and an enlarged portion, which is formed at a tip of the positioning member, is engaged to the rear portion. Further, a clamper center, which indicates a width center of the entire width dimension of each of the first and second clampers, is corresponding to a flange center, which indicates a width center of the flange diameter dimension. Between the flange diameter dimension and a first arranging width measured from the clamper center up to an upstream end on an upstream side, a relation of L1:L2=1:0.2 to 0.4 is set. Further, a tip end upper portion of each of the clamper pieces of the first and second clampers is shaped into a curved-surface-shape including a predetermined arc. Further, of the respective clamper pieces of the first and second clampers, a tip end upper portion of only each of the clamper pieces located on a most deeply inserting side or tip end upper portions of all the clamper pieces are shaped into an inclined-surface-shape.

3. Effects of the Invention

The submerged nozzle supporting-replacing mechanism according to the present invention is structured as described above, and hence the following effects can be obtained.

That is, a submerged nozzle supporting-replacing mechanism includes: first and second clampers, which are provided on a side of a lower frame of a slide valve device controlling a flow rate of molten metal from a tundish to a mold, and are located on both sides of a submerged nozzle so as to press the submerged nozzle during casting against an upper fire-proof object; a spring provided to a supporting protrusion of the lower frame, for upwardly biasing each of the clampers; two pairs of guide rails provided to a frame on the side of the lower frame, for guiding movement in a horizontal direction of the submerged nozzle; and an extruding device for pushing the submerged nozzle in the horizontal direction, in which: an entire width dimension of each of the first and second clampers is set to be smaller than a flange diameter dimension of a flange of the submerged nozzle; a positioning member, which is provided so as to be suspended from the supporting protrusion, is engaged to the first and second clampers so as to position each of the clampers; and a positioning liner, which is provided on a lower surface of the lower frame, is brought into slide-contact with an upper surface of a subsequent and fresh submerged nozzle replacing the submerged nozzle, to thereby regulate a height position of the fresh submerged nozzle during movement in the horizontal direction of the fresh submerged nozzle. Thus, simplification and downsizing of the structure of the mechanism, cost reduction of a fire-proof object, and smooth movement of the submerged nozzle to be inserted are achieved.

Further, each of clamper pieces of the first and second clampers is axially supported through a pin, the positioning member passes through a through-hole formed in a rear portion of each of the clamper pieces, and an enlarged portion, which is formed at a tip of the positioning member, is engaged to the rear portion. Thus, positioning of each of the clamper pieces of the clampers and pressing to the flange of the submerged nozzle are uniformly performed, and stable biasing to the submerged nozzle is possible.

Further, a clamper center, which indicates a width center of the entire width dimension of each of the first and second clampers, is corresponding to a flange center, which indicates a width center of the flange diameter dimension. Between the flange diameter dimension and a first arranging width measured from the clamper center up to an upstream end on an upstream side, a relation of L1:L2=1:0.2 to 0.4 is set. Thus, the fresh submerged nozzle can be smoothly inserted in below an upper fire-proof object without coming into contact with the upper fire-proof object.

Further, a tip end upper portion of each of the clamper pieces of the first and second clampers is shaped into a curved-surface-shape including a predetermined arc. Thus, both the submerged nozzle and the fresh submerged nozzle can be smoothly moved through the tip end upper portion of the curved-surface shape. Further, of the respective clamper pieces of the first and second clampers, a tip end upper portion of only each of the clamper pieces located on a most deeply inserting side or tip end upper portions of all the clamper pieces are shaped into an inclined-surface-shape. Thus, both the submerged nozzle and the fresh submerged nozzle can be smoothly moved through the tip end upper portion of the inclined-surface shape.

A submerged nozzle supporting-replacing mechanism includes: first and second clampers, which are provided on a downstream side of a stopper device controlling a flow rate of molten metal from a tundish to a mold, and are located on both sides of a submerged nozzle so as to press the submerged nozzle during casting against an upper fire-proof object; a spring provided to a supporting protrusion of the lower frame, for upwardly biasing each of the clampers; two pairs of guide rails provided to a frame on a side of the lower frame, for guiding movement in a horizontal direction of the submerged nozzle; and an extruding device for pushing the submerged nozzle in the horizontal direction, in which: an entire width dimension of each of the first and second clampers is set to be smaller than a flange diameter dimension of a flange of the submerged nozzle; a positioning member, which is provided so as to be suspended from the supporting protrusion, is engaged to the first and second clampers so as to position each of the clampers; and a positioning liner, which is provided on a lower surface of the lower frame, is brought into slide-contact with an upper surface of a subsequent and fresh submerged nozzle replacing the submerged nozzle, to thereby regulate a height position of the fresh submerged nozzle during movement in the horizontal direction of the fresh submerged nozzle. Thus, simplification and downsizing of the structure of the mechanism, cost reduction of a fire-proof object, and smooth movement of the submerged nozzle to be inserted are achieved.

Further, each of clamper pieces of the first and second clampers is axially supported through a pin, the positioning member passes through a through-hole formed in a rear portion of each of the clamper pieces, and an enlarged portion, which is formed at a tip of the positioning member, is engaged to the rear portion. Thus, positioning of each of the clamper pieces of the clampers and pressing to the flange of the submerged nozzle are uniformly performed, and stable biasing to the submerged nozzle is possible. Further, a clamper center, which indicates a width center of the entire width dimension of each of the first and second clampers, is corresponding to a flange center, which indicates a width center of the flange diameter dimension. Between the flange diameter dimension and a first arranging width measured from the clamper center up to an upstream end on an upstream side, a relation of L1:L2=1:0.2 to 0.4 is set. Thus, the fresh submerged nozzle can be smoothly inserted in below an upper fire-proof object without coming into contact with the upper fire-proof object. Further, a tip end upper portion of each of the clamper pieces of the first and second clampers is shaped into a curved-surface-shape including a predetermined arc. Thus, both the submerged nozzle and the fresh submerged nozzle can be smoothly moved through the tip end upper portion of the curved-surface shape. Further, of the respective clamper pieces of the first and second clampers, a tip end upper portion of only each of the clamper pieces located on a most deeply inserting side or tip end upper portions of all the clamper pieces are shaped into an inclined-surface-shape. Thus, both the submerged nozzle and the fresh submerged nozzle can be smoothly moved through the tip end upper portion of the inclined-surface shape.

DETAILED DESCRIPTION OF THE INVENTION

It is an object of the present invention to provide a submerged nozzle supporting-replacing mechanism, which is capable of regulating a position of each of clampers by a positioning member by setting each of entire width dimensions of the clampers to be smaller than a flange diameter dimension of a submerged nozzle, and is capable of achieving a simple and low-cost structure and a reduction in size and weight of a fire-proof object by regulating a height position of a fresh submerged nozzle by a positioning liner.

Hereinafter, preferred embodiments of a submerged nozzle supporting-replacing mechanism according to the present invention are described with reference to the drawings.

Figure 1:
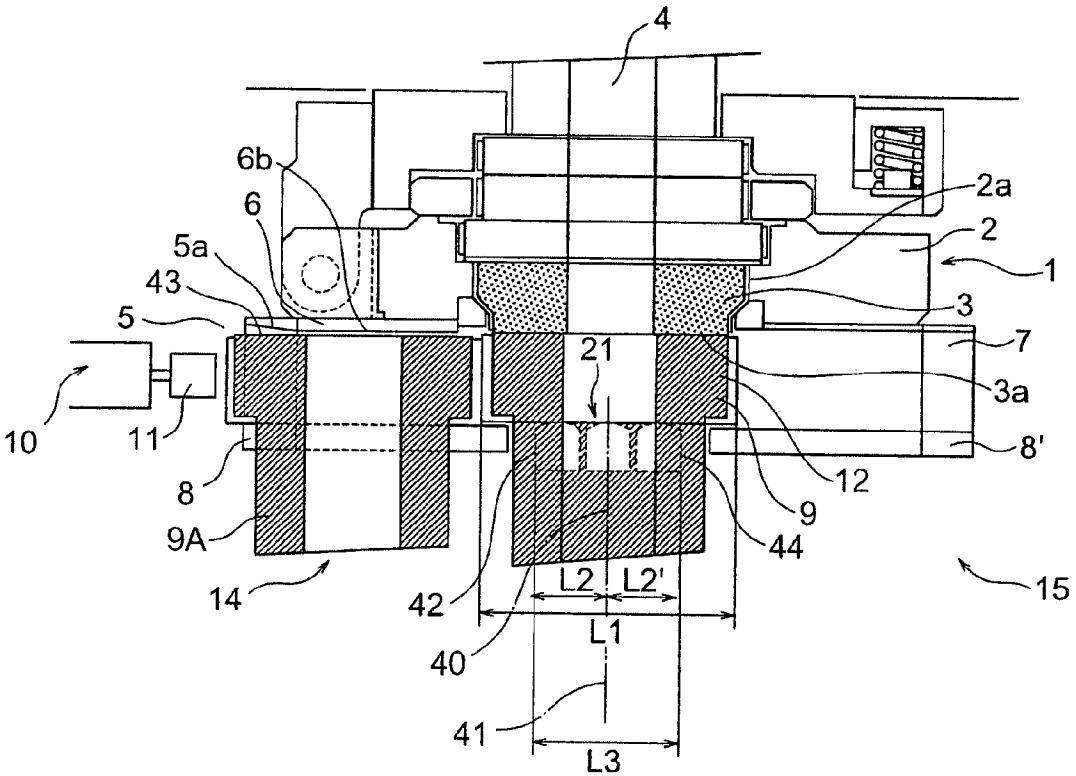
FIG. 1 is a cross-sectional view illustrating a submerged nozzle supporting-replacing mechanism according to the present invention.

FIG. 1 illustrates a known slide valve device 1. An opening 2*a* is formed in a lower frame 2 of the slide valve device 1. An upper fire-proof object 3, continuous with a tapping hole 4, is provided in the opening 2*a*.

In a lower surface of the lower frame 2, there is provided a positioning liner 6, which includes a taper surface 5*a* formed on an inserting side 5. Two pairs of guide rails 8 and 8' on the inserting side and a side opposite thereto are provided on a lower portion of a frame 7, which is formed so as to be suspended from the lower surface of the lower frame 2. In this structure, a submerged nozzle 9 and a subsequent and fresh submerged-nozzle 9A for replacement can be extruded and moved through a flange 12 by a pushing portion 11 of an extruding device 10 in a horizontal direction on each of the guide rails 8 and 8'.

In this structure, the fresh submerged-nozzle 9A is positioned at an inserting position 14, and the submerged nozzle 9 can be removed at a removing position 15. It is possible to detachably provide the extruding device 10 on the slide valve device 1 or a container for molten metal, such as a tundish (not shown). Note that, joint surfaces of upper surfaces 43 of the submerged nozzles 9 and 9A are structured so as to be equivalent in size to a lower joint surface 3*a* of the upper fire-proof object 3.

On a lower surface of the frame 7, there is provided a pair of first and second clampers 20 and 21. The clampers 20 and 21 are opposed to each other while sandwiching the submerged nozzle 9 along a direction orthogonal to a longitudinal direction of each of the guide rails 8 and 8'.

Figure 4:
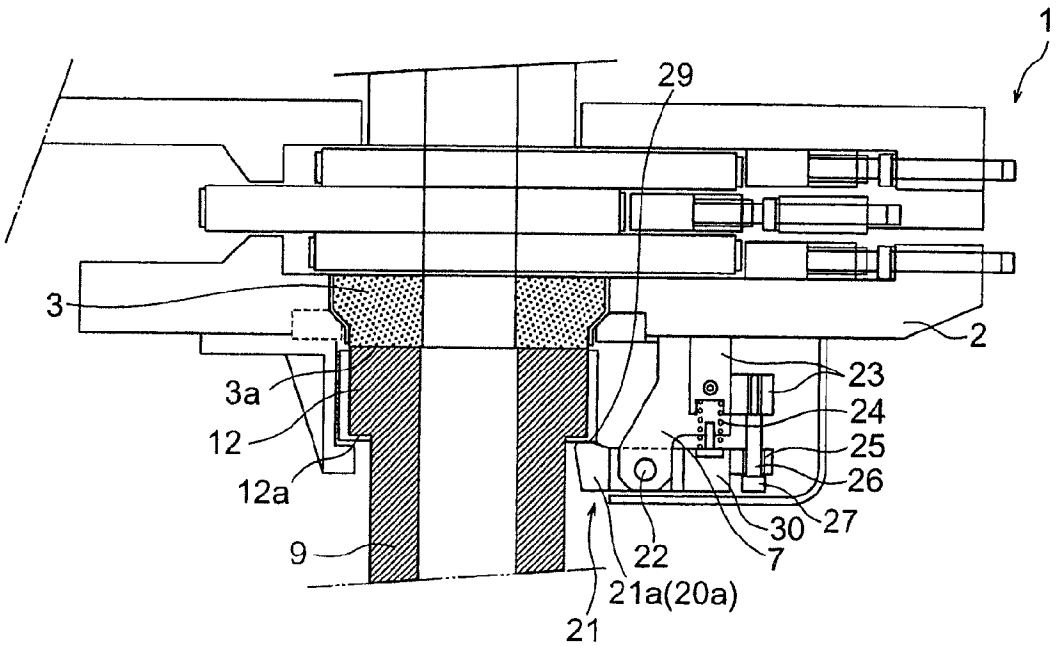
FIG. 4 is a side cross-sectional view of FIG. 1.

Each of the clampers 20 and 21 includes a plurality of, that is, three clamper pieces 20*a* and 21*a* which are provided in parallel to each other. As illustrated in FIG. 4, each of the clamper pieces 20*a* and 21*a* is structured such that its tip end upper portion 29 can come into contact and slide-contact with a flange lower surface 12*a* of the flange 12.

Each of the clamper pieces 20*a* and 21*a* is axially supported by a pin 22 supported by the lower frame 2 so that each of the clamper pieces is allowed to oscillate. Compression-type springs 24 are provided in L-shaped supporting protrusions 23, which are provided on the lower frame 2 so as to be suspended from the lower frame 2. The compression-type springs 24 push rear portions 30 of the clamper pieces 20*a* and 21*a*. Thus, the tip end upper portion 29 comes into contact with the flange lower surface 12*a* of the flange 12 so as to be biased. Thus, in this way, the flange 12 comes into contact with the lower joint surface 3*a* of the upper fire-proof object 3.

In the rear portion 30 of each of the clamper pieces 20*a* and 21*a*, there is formed a through-hole 25. A positioning member 26, which forms a stick-shape downwardly suspended from the supporting protrusion 23, passes through the through-hole 25. A flange-like enlarged portion 27, which is provided on a lower end of the positioning member 26, is located at a lower surface of the clamper piece 21*a* (20*a*). In this way, detachment of the rear portion 30 of each of the clamper pieces 20*a* and 21*a* is prevented by the positioning member 26. Due to the enlarged portion 27, a biasing force with respect to a flange lower surface 12*a* during oscillation of each clamper piece 21*a* (20*a*) is restricted. That is, a stopper action is obtained in this structure.

Note that, in FIG. 4, only the second clamper 21 is illustrated in a cross-section and the first clamper 20 is omitted.

However, even with regard to the first clamper 20, the same cross-sectional structure as that of FIG. 4 is constituted.

Further, an embodiment illustrated in FIG. 8 to FIG. 11 can be seen as another embodiment of the positioning member 26 and the enlarged portion 27 serving as the stopper, which are described above and are illustrated in FIG. 4 and FIG. 5.

Figure 5:
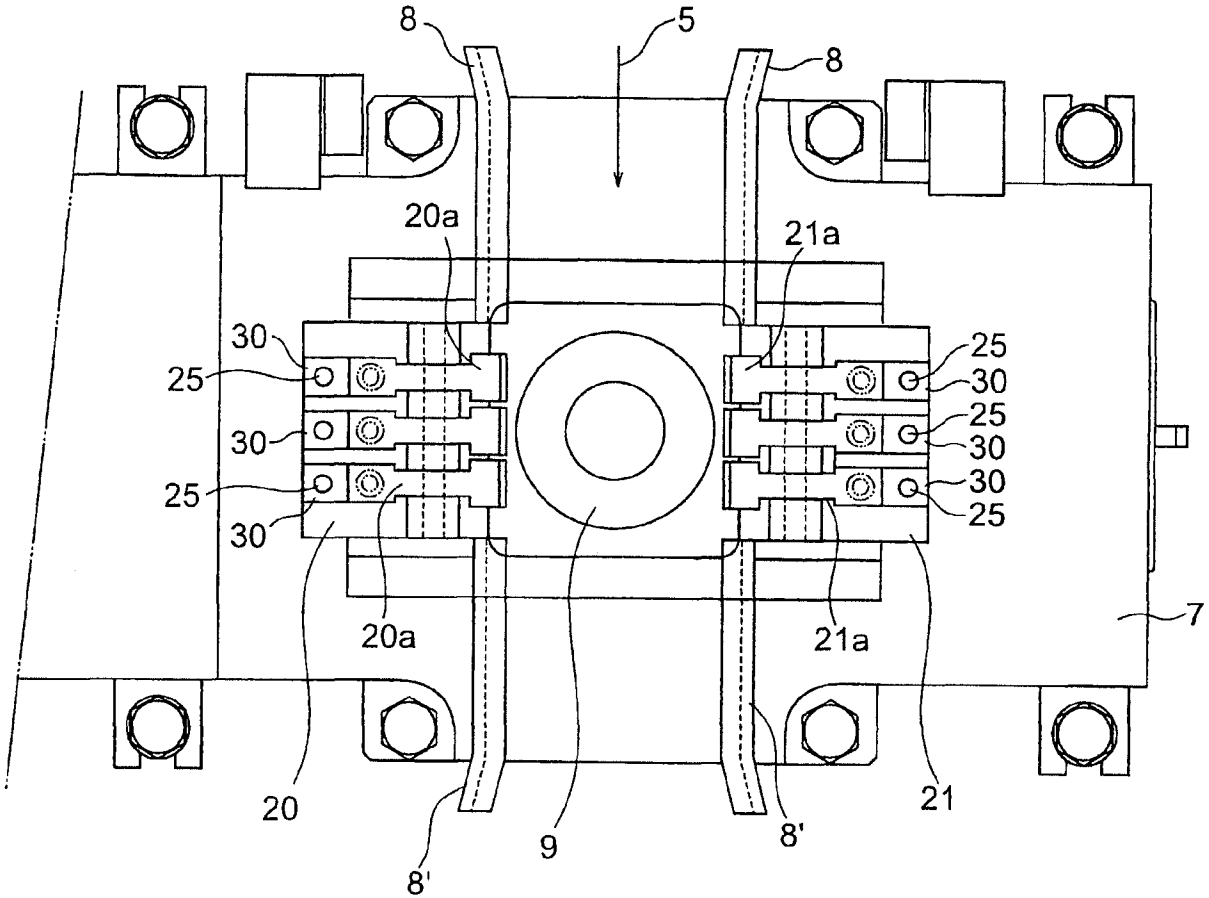
FIG. 5 is a bottom view of FIG. 4.

Note that, the same portions as those in FIG. 4 and FIG. 5 are denoted by the same reference symbols, the description thereof is omitted, and only different parts are described.

Figure 9:
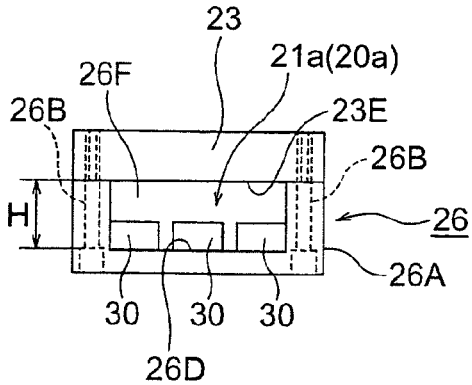
FIG. 9 is a side view illustrating a positioning member of FIG. 8.

That is, as illustrated in FIG. 9, the positioning member 26 includes: a recessed member 26A, which is connected to the supporting protrusion 23; and bolts 26B, with which an upper portion of the recessed member 26A is fixed so as to be put in a closed state by the supporting protrusion 23 forming an L-shape. A space 26F of a height H is formed between an inner bottom surface 26D of the recessed member 26A and a lower surface 23E of the supporting protrusion 23. Further, the positioning member 26 is formed, as in a case of FIG. 4, so as to be downwardly suspended from the supporting protrusion 23 in an integrated state with the supporting protrusion 23. Note that, in FIG. 9, though only one side is illustrated, the other side is constituted in the same manner.

In the above-mentioned structure, the respective rear portions 30 of the respective clamper pieces 21*a* (20*a*) are engaged to the positioning member 26 so as to be arranged within the space 26F. In the inner bottom surface 26D within the height H of the space 26F, regulation of rotational operation of each of the rear portions 30 is performed similarly to the above-mentioned operation of the embodiment of FIG. 4.

Figure 10:
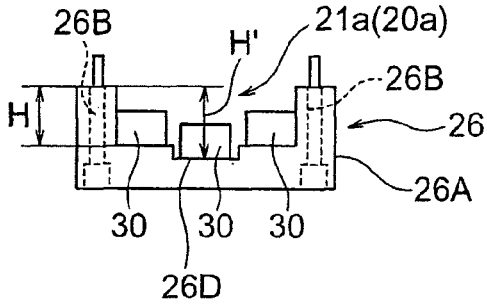
FIG. 10 is a configuration diagram illustrating another mode of FIG. 4.
Figure 11:
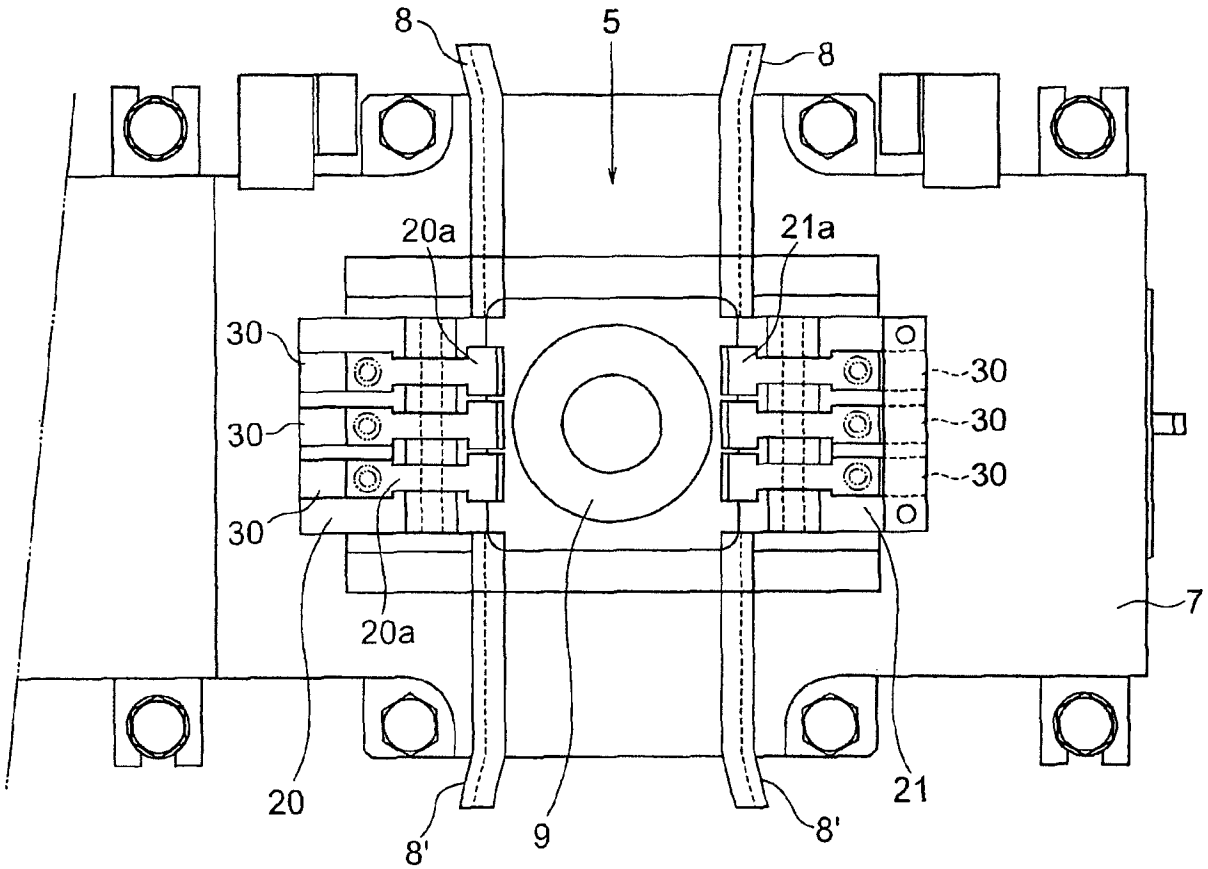
FIG. 11 is a bottom view of FIG. 8.

Further, FIG. 10 illustrates another embodiment of the embodiment of FIG. 9. It is possible to vary regulation within a rotation range of the clamper pieces 21*a* (20*a*) by changing the height H of a part of the inner bottom surface 26D to a height H'.

A clamper center 40 indicates a width center of each of entire width dimensions L3 of the first clamper 20 and the second clamper 21. A flange center 41 indicates a width center of a flange diameter dimension L1 of the flange 12. The clamper center 40 corresponds to the flange center 41. A first arranging width L2 indicates a width measured from the clamper center 40 toward an inserting side 5 of each of the clampers 20 and 21 up to an upstream end 42 on an upstream side. A relation between the first arranging width L2 and the flange diameter dimension L1 can be L1:L2=1:0.2 to 0.4 (note that, an optimum value is L1:L2=1:0.3), on the condition that an upper surface 43 of the fresh submerged nozzle 9A, which is freshly inserted and moves, smoothly enters below the upper fire-proof object 3 without coming into contact with the upper fire-proof object 3. With regard to a second arranging width L2' on a downstream end 44 side illustrated in FIG. 1, though it is not particularly limited, a relation of L1/2 or less is suitable. That is, with the above-mentioned structure, in a case where the fresh submerged nozzle 9A moves up to the tapping hole 4, the fresh submerged nozzle 9A is allowed to smoothly enter below the upper fire-proof object 3 without coming into contact with the upper fire-proof object 3.

Figure 2:
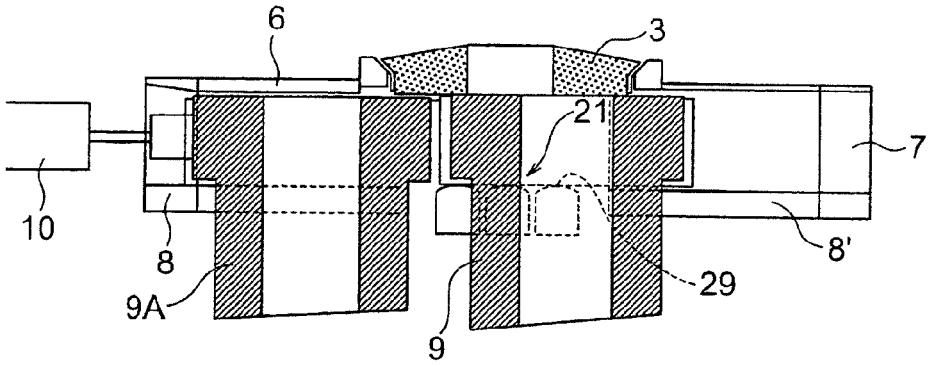
FIG. 2 is an explanation view illustrating a replacement-starting state of a submerged nozzle in FIG. 1.
Figure 3:
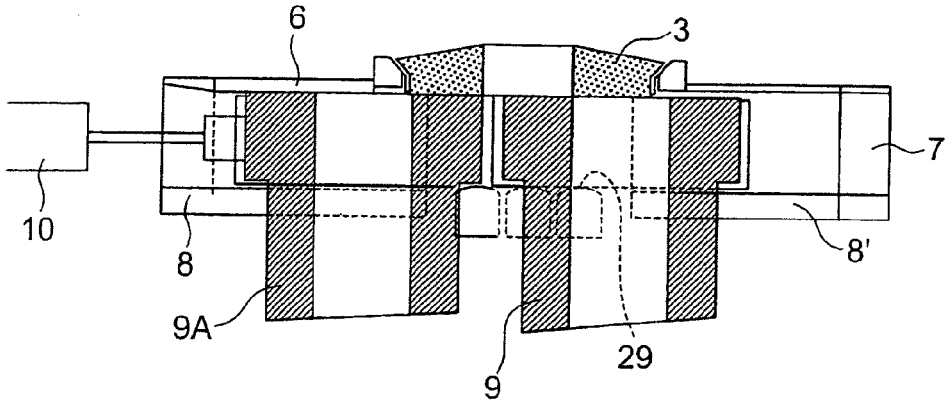
FIG. 3 is an explanation view illustrating a state in which the replacement of FIG. 2 is progressed.
Figure 6:
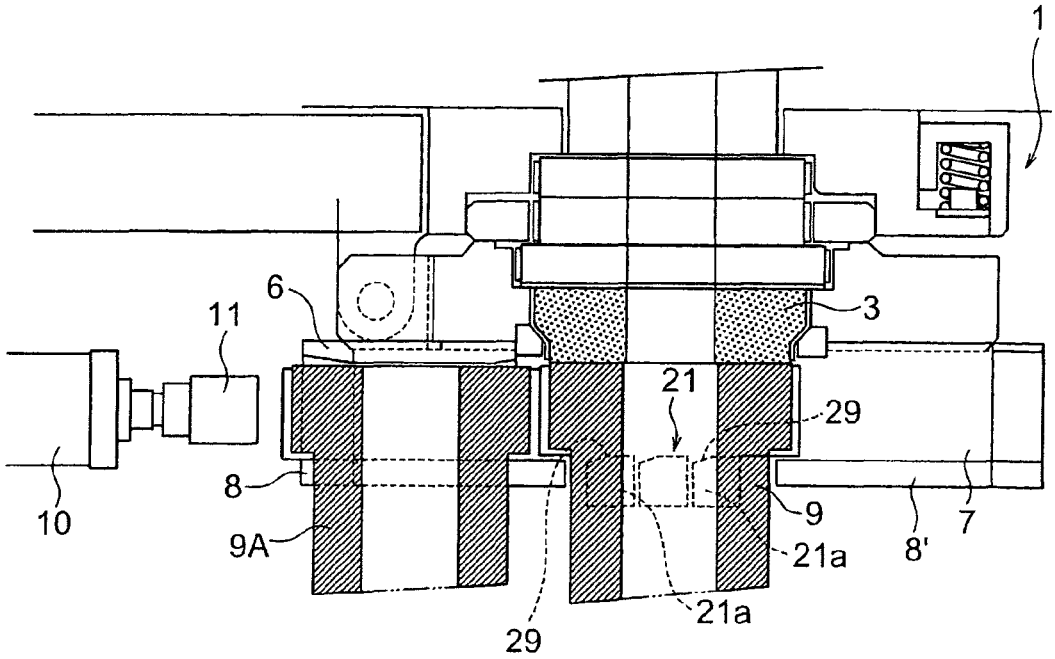
FIG. 6 is a cross-sectional view illustrating another mode of FIG. 1.
Figure 7:
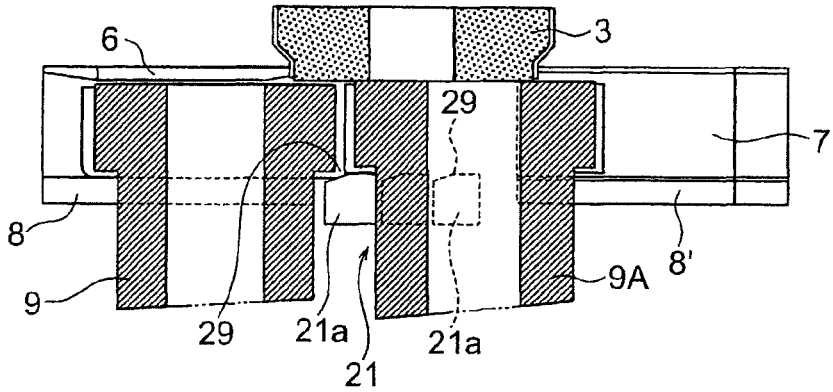
FIG. 7 is an explanation view illustrating the replacement-starting state of the submerged nozzle in FIG. 6.
Figure 8:
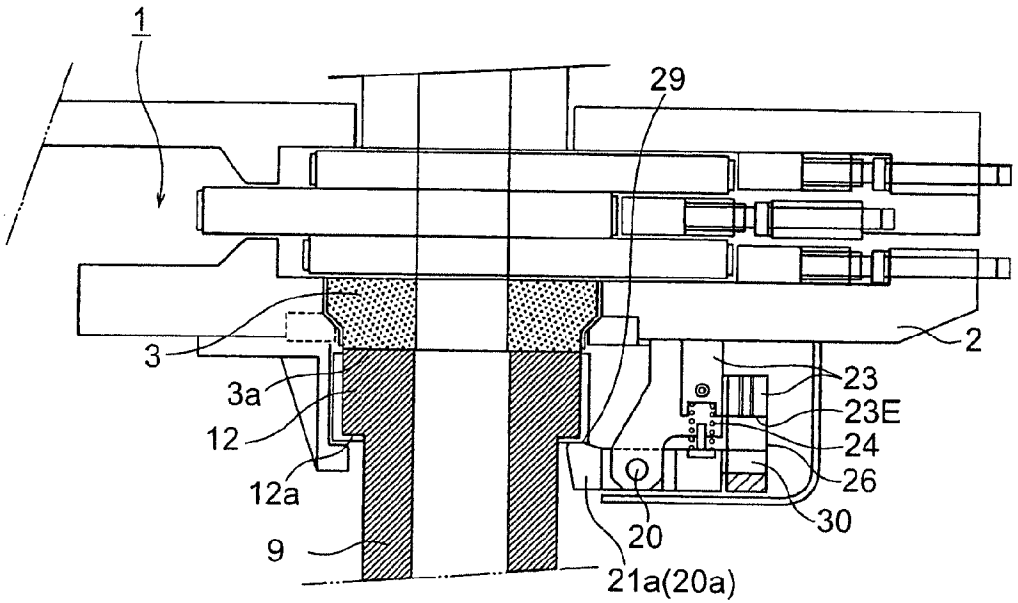
FIG. 8 is a cross-sectional view illustrating another mode of FIG. 4.

A tip end upper portion 29 of a tip of each of the clamper pieces 20*a* and 21*a* of the first and second clampers 20 and 21 is shaped into an arc-shape including a predetermined arc, that is, a curved-surface-shape, as illustrated in FIG. 2. That shape may be shaped into an inclined-surface-shape, as illustrated in FIG. 6 and FIG. 7, in which the tip end upper portion 29 of only one clamper piece 20*a* or 21*a* located on a most deeply inserting side 5 or the tip end upper portions of all the clamper pieces 20*a* or 21*a* are formed so as to be inclined downwardly toward the inserting side 5.

Next, in the above-mentioned structure, a case of actuating the submerged nozzle supporting-replacing mechanism according to the present invention is described.

In the state of FIG. 1, the submerged nozzle 9 during casting from a tundish (not shown) and to a mold is illustrated, and the submerged nozzle 9 is upwardly biased to the lower joint surface 3*a* of the upper fire-proof object 3 by each of the clampers 20 and 21.

In the above-mentioned state, in order to replace the submerged nozzle 9 with the fresh submerged nozzle 9A with respect to the upper fire-proof object 3, the following processes are performed. Specifically, the fresh submerged nozzle 9A is inserted between the guide rails 8 and the positioning liner 6. The fresh submerged nozzle 9A is pushed by the extruding device 10 to the right in FIG. 1. Then, as illustrated in FIG. 2, the submerged nozzle 9 is pushed by the moving fresh submerged nozzle 9A so as to slide on each of the clampers 20 and 21.

The fresh submerged nozzle 9A is further pushed by the extruding device 10. Then, the submerged nozzle 9 is caused to release correspondence with the upper fire-proof object 3 and is downwardly removed at the removing position 15. Further, the fresh submerged nozzle 9A obtains the correspondence with the upper fire-proof object 3, and is upwardly pressed by each of the clampers 20 and 21. In this way, the replacement work is completed.

For the above-mentioned replacement of the submerged nozzle 9, when the fresh submerged nozzle 9A moving on the guide rails 8 moves up to the tapping hole 4 of the upper fire-proof object 3, an inner surface 6*b* of the positioning liner 6 is provided so as to be flush with or positioned slightly below the lower joint surface 3*a*, and hence the upper surface 43 of the fresh submerged nozzle 9A does not rise over the lower joint surface 3*a* of the upper fire-proof object 3. Thus, it is possible to perform a nozzle replacement in a state in which damage and the like are prevented from occurring in the upper surface 43 of the fresh submerged nozzle 9A.

Further, for the above-mentioned replacement of the submerged nozzle 9, the tip end upper portion 29 of each of the clamper pieces 20*a* and 21*a* of the clampers 20 and 21 is shaped into the curved-surface-shape of the arc-shape or the inclined-surface-shape. As described above, arranging relation among the entire width dimension L3 of each of the clampers 20 and 21, the first arranging width L2, and the flange diameter dimension L1 of the submerged nozzle 9 is set, and hence the fresh submerged nozzle 9A is allowed to smoothly enter below the upper fire-proof object 3 without coming into contact with the upper fire-proof object 3.

Figure 12:
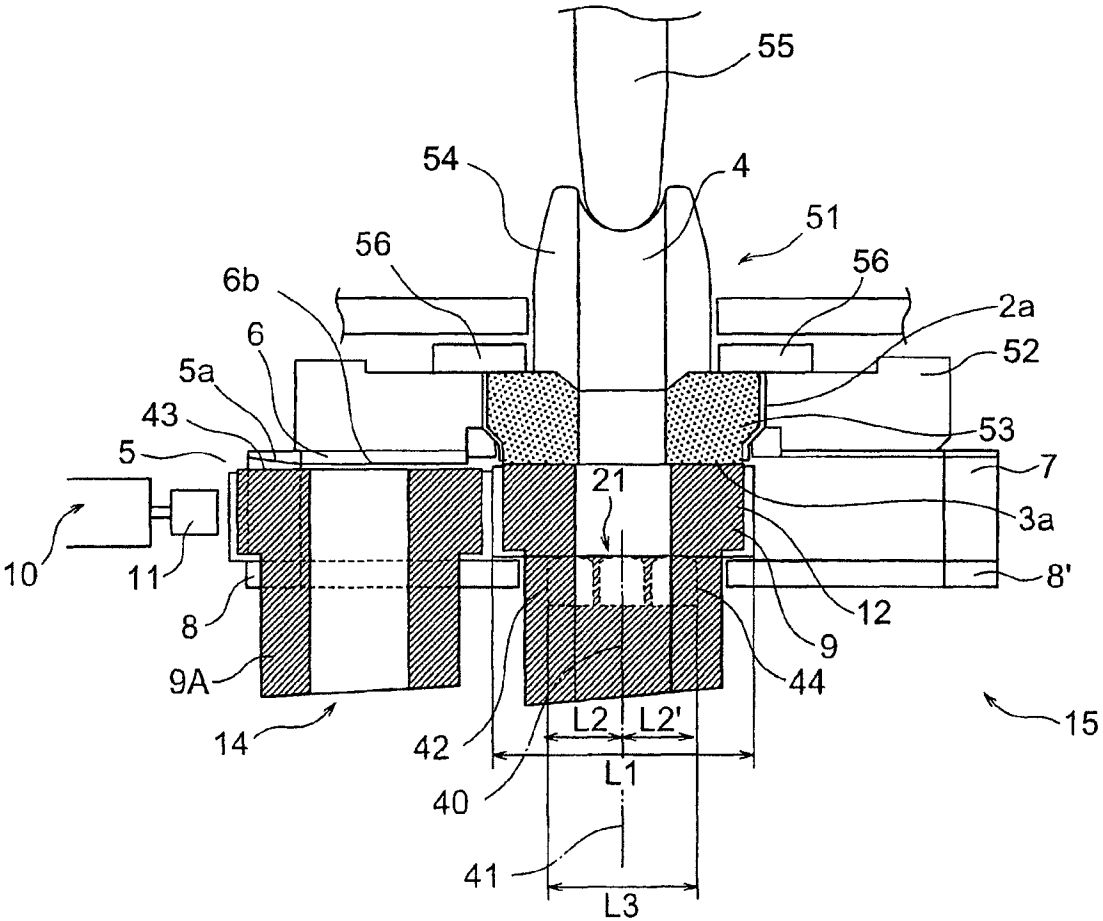
FIG. 12 is a cross-sectional view illustrating a submerged nozzle supporting-replacing mechanism according to another embodiment of the present invention.

Further, FIG. 12 illustrates another embodiment of FIG. 1 of the present invention. In this structure, the slide valve device 1 of FIG. 1 is substituted by, for example, a known stopper device 51 described in Japanese Patent Application Laid-open No. Hei 5-200504 or the like. Only a structure different from that of FIG. 1 is described, the same portions as those in FIG. 1 are denoted by the same reference symbols, and the description thereof is omitted.

Note that, also with regard to FIG. 2 to FIG. 11, the structure of FIG. 2 to FIG. 11 is completely identical other than a structure in which the slide valve device 1 is substituted by the stopper device 51 as in FIG. 12, and hence the structure of FIG. 2 to FIG. 11 is employed here.

In FIG. 12, the stopper device 51 includes an upper nozzle 54 and a stick-like stopper 55. The upper nozzle 54 is provided on an upper fire-proof object 53 retained by a lower frame 52 and includes the tapping hole 4 formed therein. The stick-like stopper 55 can be inserted in and extracted from the tapping hole 4 of the upper nozzle 54 so as to allow the tapping hole 4 to be opened and closed to control a flow rate of molten metal. The upper fire-proof object 53 is downwardly biased by a ring body 56 provided on the upper surface of the lower frame 52.

Note that, on a downstream side of the stopper device 51 for controlling a flow rate of molten metal from the tundish (not shown) to the mold, the first clamper 20, the second clamper 21, and the like for supporting and replacing the submerged nozzle 9 are constituted as illustrated in FIG. 2 to FIG. 11 described above. With regard to the replacing operation of the submerged nozzle 9, its structure is the same as the structure illustrated in FIG. 2 to FIG. 11 described above. Therefore, for the description of its operation, the above-mentioned description is employed here, and the repeated description is omitted.

The invention claimed is:

1. A submerged nozzle supporting-replacing mechanism comprising:

a slide valve device including a lower frame;

first and second clampers provided on a side of the lower frame for controlling a flow rate of molten metal from a tundish to a mold, the first and second clampers being located on opposite sides of a submerged nozzle so as to press the submerged nozzle during casting against an upper fire-proof object;

a first spring, provided on a first supporting protrusion of the lower frame, for upwardly biasing the first clamper;

a second spring, provided on a second supporting protrusion of the lower frame, for upwardly biasing the second clamper;

two pairs of guide rails for guiding movement of the submerged nozzle in a horizontal direction, the two pairs of guide rails being provided on a frame that is connected to a lower surface of the lower frame;

a first positioning member suspended from the first supporting protrusion and engaged with the first clamper so as to position the first clamper;

a second positioning member suspended from the second supporting protrusion and engaged with the second clamper so as to position the second clamper; and a positioning liner, provided on the lower surface of the lower frame, for guiding an upper surface of a subsequent and fresh submerged nozzle replacing the submerged nozzle, to thereby regulate a height position of the fresh submerged nozzle during movement in the horizontal direction; and an extruding device for pushing the submerged nozzle in the horizontal direction, wherein:

an entire width dimension (L3) of each of the first and second clampers is smaller than a flange diameter dimension (L1) of a flange of the submerged nozzle;

each of clamper pieces of the first and second clampers is axially supported through a pin;

the first positioning member passes through a through-hole formed in a rear portion of one of the clamper pieces of the first clamper;

the second positioning member passes through a through-hole formed in a rear portion of one of the clamper pieces of the second clamper; and each of the first and second positioning members includes an enlarged portion at a tip thereof, the enlarged portion being engagable with a rear portion of the respective clamper.

2. A submerged nozzle supporting-replacing mechanism according to claim 1, wherein a tip end upper portion of each of the clamper pieces of the first and second clampers is shaped into a curved-surface-shape including a predetermined arc.

3. A submerged nozzle supporting-replacing mechanism according to claim 1, wherein, of the respective clamper pieces of the first and second clampers, a tip end upper portion of only each of the clamper pieces located on a most deeply inserting side or tip end upper portions of all the clamper pieces are shaped into an inclined-surface-shape.

4. A submerged nozzle supporting-replacing mechanism comprising:

a slide valve device including a lower frame;

first and second clampers provided on a side of the lower frame for controlling a flow rate of molten metal from a tundish to a mold, the first and second clampers being located on opposite sides of a submerged nozzle so as to press the submerged nozzle during casting against an upper fire-proof object;

a first spring, provided on a first supporting protrusion of the lower frame, for upwardly biasing the first clamper;

a second spring, provided on a second supporting protrusion of the lower frame, for upwardly biasing the second clamper;

two pairs of guide rails for guiding movement of the submerged nozzle in a horizontal direction, the two pairs of guide rails being provided on a frame that is connected to a lower surface of the lower frame;

a first positioning member suspended from the first supporting protrusion and engaged with the first clamper so as to position the first clamper;

a second positioning member suspended from the second supporting protrusion and engaged with the second clamper so as to position the second clamper; and a positioning liner, provided on the lower surface of the lower frame, for guiding an upper surface of a subsequent and fresh submerged nozzle replacing the submerged nozzle, to thereby regulate a height position of the fresh submerged nozzle during movement in the horizontal direction; and an extruding device for pushing the submerged nozzle in the horizontal direction, wherein:

an entire width dimension (L3) of each of the first and second clampers is smaller than a flange diameter dimension (L1) of a flange of the submerged nozzle;

a clamper center, which indicates a width center of the entire width dimension (L3) of each of the first and second clampers corresponds to a flange center, which indicates a width center of the flange diameter dimension (L1); and between the flange diameter dimension (L1) and a first arranging width (L2) measured from the clamper center up to an upstream end on an upstream side, a relation of L1:L2=1:0.2 to 0.4 is set.

5. A submerged nozzle supporting-replacing mechanism according to claim 4, wherein each of the first and second clampers includes a plurality of clamper pieces, and a tip end upper portion of each of the clamper pieces of the first and second clampers is shaped into a curved-surface-shape including a predetermined arc.

6. A submerged nozzle supporting-replacing mechanism according to claim 4, wherein each of the first and second clampers includes a plurality of clamper pieces, and wherein, of the respective clamper pieces of the first and second clampers, a tip end upper portion of only each of the clamper pieces located on a most deeply inserting side or tip end upper portions of all the clamper pieces are shaped into an inclined-surface-shape.

7. A submerged nozzle supporting-replacing mechanism comprising:

a lower frame;

a stopper device for controlling a flow rate of molten metal from a tundish to a mold;

first and second clampers located on opposite sides of a submerged nozzle so as to press the submerged nozzle during casting against an upper fire-proof object, the first and second clampers being provided on a downstream side of the stopper device;

a first spring, provided on a first supporting protrusion of the lower frame, for upwardly biasing the first clamper;

a second spring, provided on a second supporting protrusion of the lower frame, for upwardly biasing the second clamper;

two pairs of guide rails for guiding movement of the submerged nozzle in a horizontal direction, the two pairs of guide rails being provided on a frame that is connected to the lower frame;

a first positioning member suspended from the first supporting protrusion and engaged with the first clamper so as to position the first clamper;

a second positioning member suspended from the second supporting protrusion and engaged with the second clamper so as to position the second clamper; and a positioning liner, provided on the lower surface of the lower frame, for guiding an upper surface of a subsequent and fresh submerged nozzle replacing the submerged nozzle, to thereby regulate a height position of the fresh submerged nozzle during movement in the horizontal direction; and an extruding device for pushing the submerged nozzle in the horizontal direction, wherein:

an entire width dimension (L3) of each of the first and second clampers is smaller than a flange diameter dimension (L1) of a flange of the submerged nozzle;

each of clamper pieces of the first and second clampers is axially supported through a pin;

the first positioning member passes through a through-hole formed in a rear portion of each of one of the clamper pieces of the first clamper;

the second positioning member passes through a through-hole formed in a rear portion of one of the clamper pieces of the second clamper; and each of the first and second positioning members includes an enlarged portion at a tip thereof, the enlarged portion being engagable with a rear portion of the respective clamper.

8. A submerged nozzle supporting-replacing mechanism according to claim 7, wherein a tip end upper portion of each of the clamper pieces of the first and second clampers is shaped into a curved-surface-shape including a predetermined arc.

9. A submerged nozzle supporting-replacing mechanism according to claim 7, wherein, of the respective clamper pieces of the first and second clampers, a tip end upper portion of only each of the clamper pieces located on a most deeply inserting side or tip end upper portions of all the clamper pieces are shaped into an inclined-surface-shape.

10. A submerged nozzle supporting-replacing mechanism comprising:

a lower frame;

a stopper device for controlling a flow rate of molten metal from a tundish to a mold;

first and second clampers located on opposite sides of a submerged nozzle so as to press the submerged nozzle during casting against an upper fire-proof object, the first and second clampers being provided on a downstream side of the stopper device;

a first spring, provided on a first supporting protrusion of the lower frame, for upwardly biasing the first clamper;

a second spring, provided on a second supporting protrusion of the lower frame, for upwardly biasing the second clamper;

two pairs of guide rails for guiding movement of the submerged nozzle in a horizontal direction, the two pairs of guide rails being provided on a frame that is connected to the lower frame;

a first positioning member suspended from the first supporting protrusion and engaged with the first clamper so as to position the first clamper;

a second positioning member suspended from the second supporting protrusion and engaged with the second clamper so as to position the second clamper; and a positioning liner, provided on the lower surface of the lower frame, for guiding an upper surface of a subsequent and fresh submerged nozzle replacing the submerged nozzle, to thereby regulate a height position of the fresh submerged nozzle during movement in the horizontal direction; and an extruding device for pushing the submerged nozzle in the horizontal direction, wherein:

an entire width dimension (L3) of each of the first and second clampers is smaller than a flange diameter dimension (L1) of a flange of the submerged nozzle;

a clamper center, which indicates a width center of the entire width dimension (L3) of each of the first and second clampers corresponds to a flange center, which indicates a width center of the flange diameter dimension (L1); and between the flange diameter dimension (L1) and a first arranging width (L2) measured from the clamper center up to an upstream end on an upstream side, a relation of L1:L2=1:0.2 to 0.4 is set.

11. A submerged nozzle supporting-replacing mechanism according to claim 10, wherein each of the first and second clampers includes a plurality of clamper pieces, and a tip end upper portion of each of the clamper pieces of the first and second clampers is shaped into a curved-surface-shape including a predetermined arc.

12. A submerged nozzle supporting-replacing mechanism according to claim 10, wherein each of the first and second clampers includes a plurality of clamper pieces, and wherein, of the respective clamper pieces of the first and second clampers, a tip end upper portion of only each of the clamper pieces located on a most deeply inserting side or tip end upper portions of all the clamper pieces are shaped into an inclined-surface-shape.

* * * * *